United States Patent [19]

Sugito et al.

[11] 4,297,109

[45] Oct. 27, 1981

[54] FUEL COMPOSITION

[75] Inventors: Kazuo Sugito, Kashihara; Sakuzo Takeda, Tsu, both of Japan

[73] Assignee: Sekisui Kaseihin Kogyo Kabushiki Kaisha, Nara, Japan

[21] Appl. No.: 165,267

[22] Filed: Jul. 2, 1980

[30] Foreign Application Priority Data

Jul. 4, 1979 [JP] Japan ..... 54/85436

[51] Int. Cl.[3] ..... C10L 1/18

[52] U.S. Cl. ..... 44/56

[58] Field of Search ..... 44/56

[56] References Cited

U.S. PATENT DOCUMENTS 1,165,462 12/1915 Stevens ..... 44/56

4,207,076 6/1980 Bove et al. ..... 44/56

OTHER PUBLICATIONS

Weast, "CRC Handbook of Chemistry & Physics", 1977, pp. c-248, c-303.

Hawley, Condensed Chemical Dictionary, 8th Ed., p. 375.

*Primary Examiner*—Patrick Garvin

*Assistant Examiner*—Y. Harris-Smith

*Attorney, Agent, or Firm*—Armstrong, Nikaido, Marmelstein & Kubovcik

[57] ABSTRACT

A fuel composition comprising a fuel with a gasoline-boiling point range and a vegetable oil containing 1,8-cineole as a major component.

11 Claims, 3 Drawing Figures

FUEL COMPOSITION

BACKGROUND OF THE INVENTION

1. Field of the Invention

This invention relates to a fuel composition comprising a fuel with a gasoline-boiling point range and a vegetable oil containing 1,8-cineole as a major component, which has an improved octane number with less toxicity and which produces, after combustion, an exhaust containing carbon monoxide only in a slight concentration.

2. Description of the Prior Art

With the coming exhaustion of resources, it has been a recent increasing tendency to search for energy carrier capable of being used as a substitute energy. In particular, a liquid fuel capable of taking the place of petroleum has been desired as a fuel for internal combustion engine. However, in consideration of anti-knock performance, output power, fuel consumption per hour, toxicity, and poisonous ingredients in a combustion exhaust, fuels capable of taking the place of petroleum are difficult to find out.

As a fuel for automobiles, anti-knock performance is of a particular importance, and a fuel with a high octane number is required. Tetraethyllead has so far been popularly used for improving the anti-knock performance (or improving octane number). However, the use thereof is being restricted due to its toxicity and, after combustion, problem of causing atmospheric pollution.

It has been a recent practice to incorporate benzene, toluene, xylene, etc. in gasoline for improving the octane number, but these additives are also obtained from finite and exhausting fossil fuel such as petroleum or coal and are therefore restricted by the shortage of resources.

Further, from the point of view of poisonous ingredients contained in an exhaust, an exhaust of conventional gasoline contains carbon monoxide at such a high level in addition to the above-described lead compound that atmospheric pollution due to carbon monoxide has become a serious environmental problem.

As a result of various practical investigations to solve these problems, the inventors have found that a vegetable oil containing 1,8-cineole as a major component, when used as a fuel for internal combustion engine, surprisingly shows itself a high octane number, produces a high output power, and shows a low fuel consumption. Further, it has been found that the octane number of a fuel can be improved, without the addition of tetraethyllead or the like, by adding the vegetable oil to a fuel having a gasoline-boiling point range as an octane number improver and/or a fuel to prepare a fuel composition which exhibits the same performance as ordinarily used gasoline and which reduces the amount of carbon monoxide in a combustion exhaust. Thus, the present invention was achieved.

SUMMARY OF THE INVENTION

An object of the present invention is to provide a fuel composition comprising a fuel with a gasoline-boiling point range and a vegetable oil containing 1,8-cineole as a major component.

DETAILED DESCRIPTION OF THE INVENTION

Figure 1:
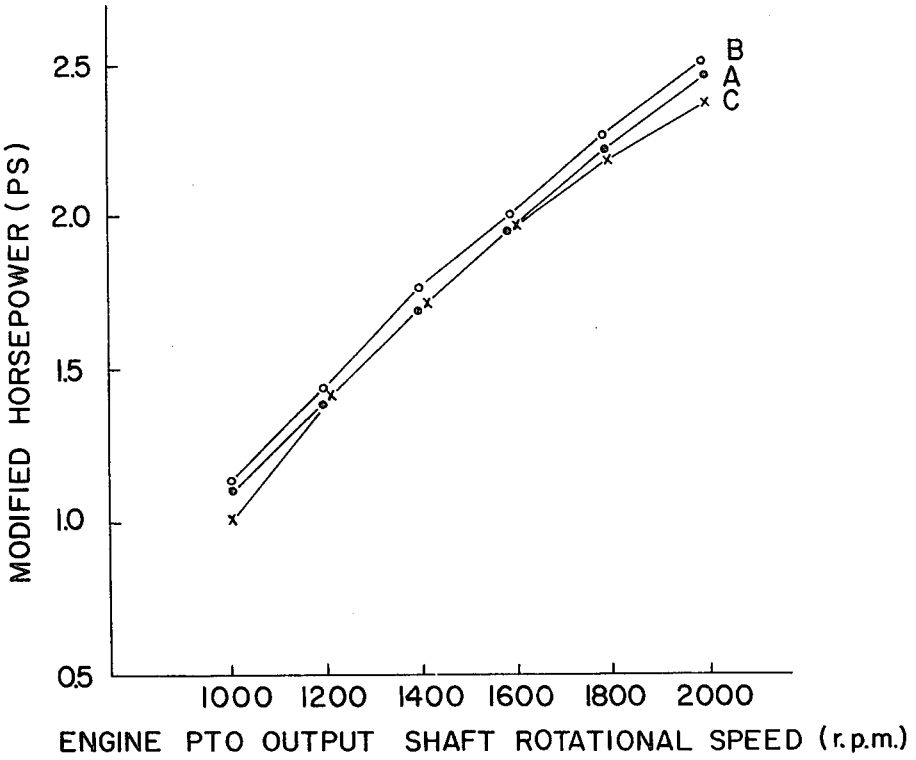
FIG. 1 is a graph showing the relationship between the modified horsepower (PS) and the engine PTO output shaft rotational speed (r.p.m.) as to 100% commercially available gasoline, 100% eucalyptus oil, and a mixture (70:30 by volume) of eucalyptus oil and gasoline.

As the fuel having a gasoline-boiling point range which can be used in the present invention, most of all of commercially available gasolines, that is, liquid hydrocarbon fuels having a boiling point range of from about 60° C. to about 200° C. (i.e., as is well known, mixtures of hydrocarbons containing aromatic, olefinic, paraffinic, and naphthenic hydrocarbons) are included. As such gasolines, not only straight run gasoline but also those obtained by cracking, polymerization, or other chemical reaction of naturally occurring petroleum hydrocarbons to convert to products with good combustion properties can be used. For the purpose of the present invention, motor gasoline as defined in ASTM D 439-74 is preferred. In the case of using then for an internal combustion engine, various products not belonging to the category of gasoline can also be used as one of the components of the composition of the present invention if they have an intrinsic boiling point range, vapor pressure and performance characteristics corresponding to those of gasoline. For example, some oxygen-containing compounds can be used as one of the components of the composition of the present invention. Suitable examples of the oxygen-containing compounds which can be used include lower aliphatic alcohols such as methyl alcohol, ethyl alcohol, n-propyl alcohol, isopropoyl alcohol, n-butyl alcohol, sec-butyl alcohol, isobutyl alcohol, etc. These compounds can be used alone or in combination of two or more.

Such oxygen-containing compounds can be added in an amount of up to 100 v/v to the amount of gasoline contained in the composition of the present invention. The oxygen-containing compounds have water absorption properties and when added to to gasoline itself, they are homogeneously mixed therewith in a state substantially free from water. However, when even a slight amount of water is present or the mixture is allowed to stand whereby water is absorbed, there is observed a tendency for phase separation into two phases, i.e., water phase and gasoline phase. For this reason, it has been considered in the art that the maximum amount of, for example, ethyl alcohol to be added to ordinarily used gasoline is 25 v/v. In contrast, since 1,8-cineole according to the present invention can be homogeneously mixed with the oxy-containing compound in a water-absorbed state and gasoline free from the phase separation, there is not found any problem in this invention even when an oxygen-containing compound even absorbing therein a small amount of water is added in an amount of more than 25 v/v to the amount of gasoline contained in the composition of the present invention. However, since the use of the oxygen-containing compound in an amount exceeding 100 v/v to the amount of gasoline contained in the composition of the present requires improvements of an engine and other mechanism, such is not preferred.

Gasolines with a comparatively low octane number are particularly advantageous to be mixed with the vegetable oil containing 1,8-cineole as a major component. Specifically, gasolines with an octane number of 85 or less are advantageous; for example, straight-run gasoline is suited. The use of gasolines with a low octane number is advantageous because they are not subjected to such processings as modification and can be always available inexpensively as compared to processed petroleum products. In addition, the vegetable oil containing 1,8-cineole as a major component has a comparatively high and narrow boiling point range of about 160° to 180° C., and hence a fuel containing comparatively low boiling fraction in high content is preferable as the another component of the composition of the present invention from various points (for example, ignition properties, etc.).

Sulfur ingredients cause atmospheric pollution of smog and exert other detrimental influences, and hence the fuel with a gasoline-boiling point range to be used in the present invention preferably contains about 0.1 wt% or less, more preferably about 0.02 wt% or less, sulfur ingredients.

As the vegetable oil containing as a major component 1,8-cineole represented by the following formula:

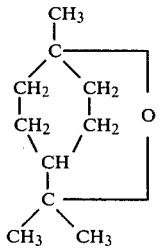

which can be used for the fuel composition of the present invention, there is suitably used an eucalyptus oil obtained by finely cutting leaves of eucalyptus and subjecting the pieces to steam distillation by applying steam thereto. In addition, a product containing as a major component 1,8-cineole separated from camphor white oil can also be used. These vegetable oils are preferably purified through distillation to remove plant gum and water-soluble ingredients. In addition to these vegetable oils directly separated from natural products, synthetic products obtained by converting terpene to an acid followed by dehydrating can be used as well.

The vegetable oil containing 1,8-cineole as a major component usually means a vegetable oil containing 50% by volume or more of 1,8-cineole. Vegetable oils preferable for the purpose of the present invention are those containing 70% by volume or more, preferably 85% by volume or more, of 1,8-cineole.

1,8-Cineole is a colorless or pale yellow, transparent liquid having a camphor-like smell and giving a refreshing taste, and is used for a dentifrice, oral refrigerant, air freshner, plaster, etc. It is officially accepted as a food additive and is described as an eucalyptus oil in the Pharmacopoeia of Japan, thus being itself extremely less toxic. Moreover, it has the advantage that it produces a combustion exhaust containing an extremely low concentration of carbon monoxide. Accordingly, the fuel composition obtained by mixing with a fuel having a gasoline-boiling point range can be said to be a fuel scarcely causing environmental pollution.

The volume metric mixing ratio of (a) a fuel with a gasoline-boiling point range to (b) a vegetable oil containing 1,8-cineole as a major component in the fuel composition of the present invention is usually selected within the range of (a):(b)=95:5 to 5:95, preferably 70:30 to 30:70.

Additionally, to the composition of the present invention may properly be added those additives which are added to ordinary, commercially available gasoline, such as a deposit improver, antioxidant, metal-inactivator, corrosion inhibitor, anti-icing agent, detergent, etc.

The one component of the composition of the present invention can be comparatively easily separated from vegetables such as eucalyptus, thus the present invention being extremely advantageous. That is, planted vegetables improve environments, accumulate solar energy and, upon taking out the solar energy, cause no environmental pollution. Besides, vegetables are produced infinitely by photosynthesis and are therefore infinite resources.

The present invention will now be described in more detail by reference to the Test Examples and Examples.

TEST EXAMPLE 1

An eucalyptus oil (containing 93.4 vol.% of 1,8-cineole) having the following physical properties was tested.

| Physical Properties of Eucalyptus Oil | |
|---|---|
| (i) Specific gravity: | 0.9137 (15/4° C.) |
| (ii) Flash point: | 54° C. |
| (iii) Viscosity: | ≦2.0 Cst (50° C.) |
| (iv) 10% Residual oil remaining carbon: | 0.08% |
| (v) Copper plate corrosion test: | Ia (copper plate surface remaining fresh) |
| (vi) Distillation test: | |
| Initial boiling point: | 167° C. |
| 10% Distillation point: | 172° C. |
| 20% Distillation point: | 172° C. |
| 30% Distillation point: | 172° C. |
| 40% Distillation point: | 172° C. |
| 50% Distillation point: | 173° C. |
| 60% Distillation point: | 173° C. |
| 70% Distillation point: | 173° C. |
| 80% Distillation point: | 173° C. |
| 90% Distillation point: | 174° C. |
| 95% Distillation point: | 174° C. |
| Final distillation point: | 181° C. |
| Total distillation point: | 98 ml |
| Remaining oil | 1.5 ml |

(Additionally, the above-described properties were measured according to testing methods prescribed in Japanese Industrial Standards (JIS K 2280)).

80 parts by volume of a mixture of 60 vol.% isooctane and 40 vol.% n-heptane was mixed with 20 parts by volume of the above-described eucalyptus oil to prepare a uniform mixture.

The above-described mixture was charged in a CFR engine (co-operative fuel research test engine) to conduct a CFR engine test. Thus, the mixture was found to have a Research Octane Number of 67.9. Therefore, the octane number of this eucalyptus oil mixture was found to be 99.5.

Additionally, the CFR engine test was conducted under the following conditions by adjusting an engine compression ratio so as to set a CFR engine knock meter to 50.

| | |
|---|---|
| Room temperature: | 18.8° C. |
| Atmospheric pressure: | 760 mmHg |
| Engine compression ratio: | $\epsilon = 5.7$ |

TEST EXAMPLE 2

The same eucalyptus oil as used in Test Example 1 was used in a pure form to conduct the CFR engine test. As a result of comparative run together with 100% isooctane, the eucalyptus oil showed an octane number of 100.1 to 100.2.

Engine running conditions in the CFR engine test are shown below.

| | |
|---|---|
| Suction gas temperature: | 124° F. (51° C.) |
| Oil temperature in crank case: | 134° F. |
| Oil pressure | 29#/12" |
| CFR engine compression ratio: | 118.0 |
| Engine oil used: | Gold Oil SAE No. 30 (a product of Mitsubishi Petroleum Co., Ltd.) |

COMPOUNDING EXAMPLES

Gasolines with various octane numbers were mixed with the eucalyptus oil used in the above-described test examples in various proportions to prepare fuel compositions. Compounding proportions and octane numbers of the respective compositions are tabulated in Table 1 below.

TABLE 1

| Compounding Example No. | Gasoline Octane Number | Gasoline Content (vol. %) | Content of Euclyptus Oil (vol. %) | Octane Number of Resulting Composition |
|---|---|---|---|---|
| 1 | 70 | 50 | 50 | 85 |
| 2 | 50 | 50 | 50 | 85 |
| 3 | 80 | 90 | 10 | 82 |
| 4 | 80 | 80 | 20 | 84 |
| 5 | 70 | 70 | 30 | 79 |
| 6 | 50 | 10 | 90 | 95 |
| 7 | 60 | 20 | 80 | 92 |
| 8 | 60 | 30 | 70 | 88 |

EXAMPLE 1

Engine tests were conducted under the conditions described below using three kinds of fuels of commercially available gasoline, eucalyptus oil as used in the test examples, and a uniform mixture of 30 vol.% commercially available gasoline and 70 vol.% eucalyptus oil. Commercially available gasoline as used herein means automobile gasoline No. 2 prescribed in Japanese Industrial Standards (JIS K2202-1965), so-called regular gasoline.

(I) Testing equipments used were as follows.

(1) Engine

-continued

| | |
|---|---|
| Name: | Mitsubishi Meiki F-25L |
| Model: | Gasoline engine of air-cooled, 4 stroke cycle, vertical type side valve type |
| Number of cylinder: | 1 |
| Bore x Stroke | 60 × 42 mm |
| Total displacement: | 118 cc |
| Continous rated horsepower: | 2.0/1800 PS/r.p.m. |
| Maximum horsepower: | 2.5/2000 PS/r.p.m. |
| Maximum torque: | 0.92/1750 KG . m/r.p.m. |
| Compression ratio: | 6.0 |
| Ignition plug: | NGK B-65 |
| Reduction type: | ½ cam shaft reduction type |
| Standard main jet nozzle diameter: | 0.725 mm |
| (2) Dynamometer | |
| Name: | DC Electric dynamometer (made by Seidensha Electric Factory) |
| Capacity: | 5KW |
| Voltage: | 200 V |
| Current: | 20 A |
| Rating rotation: | 2500 to 3000 r.p.m. |
| Load-absorbing type: | Load-resisting type |
| Arm length: | 0.2865 m |
| (3) Fuel consumption meter | |
| Digital fuel consumption meter | (made by Ono Sokki Co., Ltd.) |
| Manipulating part: | FC 244 |
| Buret part: | PP-500 |
| Measuring range: | 2.5, 5, 10, 50, 100 ml |
| (4) Tachometer | |
| Digital tachometer QR-102M (made by Ono Sokki Co., Ltd.) | |
| (5) CO concentration-measuring meter | |
| Infrared Analyzer MEXA-201B (made by Horiba Ltd.) | |
| (6) Barometer | |
| Barometer (made by Nippon Keiryoki Kogyo Co., Ltd.) (scale unit: 1 mmHg) | |

(II) Testing items and testing methods (1) Measurement of output power (Full-throttle performance test)

After starting the engine, warm-up running was fully conducted before measuring output power. The full-throttle performance test means to read the load on the dynamometer at a rotational speed of engine allowed to run with a throttle valve fully opened without permitting the engine governor to work, thus the output power being determined. In this case, loads on the dynamometer at crank shaft rotational speeds of 4000, 3600, 3200, 2800, 2400 and 2000 r.p.m. (½ thereof in terms of PTO output power shaft) were measured. The output power was calculated according to the formula to be described hereinafter.

(2) Measurement of fuel consumption

Fuel consumption (l/h)

Measurement of fuel consumption ratio (ml/PS·h)

The fuel consumption per hour (l/h) was determined by measuring the time required for consuming a certain given amount of fuel. Also, fuel consumption per PS·hr, i.e., fuel consumption ratio (ml/PS·h) was determined from the engine output power data obtained in the test. In this test, the time required for consuming 5 ml of the fuel was measured.

(3) Exhaust gas analysis:

The carbon monoxide concentration was estimated by measuring the output power and fuel consumption ratio.

(4) Others:

The atmospheric pressure, dry-bulb temperature, and wet-bulb temperature were measured.

(III) Calculation of respective characteristics:

(1) Output power: (PS)

Output power (PS)=(n×W×k)/1000

Additionally, the correcting coefficient for output power is determined by the following formula according to JIS B 8013 (method for testing small-sized internal combustion engine for land use).

$$K = \frac{748.6}{H - h}\sqrt{\frac{273 + t}{293}}$$

(2) Calculation of fuel consumption ratio;

$$B = \frac{V \times 3600}{1000 \times t}\ (l/h)$$

$$be = \frac{B}{Le} = \frac{V \times 3600}{Le \times t}\ (ml/PS \cdot h)$$

The vapor pressure of water was determined according to the following formula (Angod's formula):

$$h = h'\{1-0.0159(t-t')\} - H(t-t')\{0.0007-76-0.000028(t-t')\}$$

In the formulae described in (1) and (2), n: rotational speed of the dynamometer (r.p.m.)

W: load on the dynamometer (Kg)

K: correcting coefficient

B: fuel consumption (l/h)

V: buret measurement capacity of buret (5 ml)

t: time required for consuming V of fuel

Le: engine output power (PS)

be: fuel consumption ratio (ml/PS·h)

h: vapor pressure of water (mmHg)

h': saturated vapor pressure at t' (mmHg)

H: atmospheric pressure (mmHg)

t: dry-bulb temperature (°C.)

t': wet-bulb temperature (°C.)

(IV) Test results

| Measurement of output power and fuel consumption ratio | |
|---|---|
| Dry-bulb temperature | 31° C. |
| Wet-bulb temperature | 24.8° C. |
| Atmospheric pressure | 751.2 mmHg |
| Vapor pressure of water | 18.4 mmHg |
| K = 1.0406 | |

TABLE 2

| | | Fuel | | |
|---|---|---|---|---|
| | | A | B | C |
| Fuel Composition | | | | |
| Gasoline (v/v) | | 100 | 0 | 30 |
| Eucalyptus oil (v/v) | | 0 | 100 | 70 |
| Specific Gravity | | 0.735 | 0.9137 | 0.862 |
| Main Jet Nozzle Diameter (mm) | | 0.725 | 0.775 | 0.725 |
| | Engine PTO output shaft Rotational Speed (r.p.m.) | | | |
| Modified Horsepower (PS) | 2000 | 2.46 | 2.46 | 2.37 |
| | 1800 | 2.21 | 2.25 | 2.19 |
| | 1600 | 1.96 | 2.00 | 1.96 |
| | 1400 | 1.70 | 1.73 | 1.70 |
| | 1200 | 1.41 | 1.45 | 1.42 |
| | 1000 | 1.11 | 1.11 | 1.01 |
| Fuel Consumption Ratio (ml/PS . h) | 2000 | 441 | 385 | 393 |
| | 1800 | 445 | 382 | 379 |
| | 1600 | 459 | 375 | 378 |
| | 1400 | 466 | 390 | 388 |
| | 1200 | 484 | 403 | 396 |
| | 1000 | 528 | 434 | 459 |
| Carbon Monoxide Concentration (%) | 2000 | 4.6 | 1.2 | 1.3-1.4 |
| | 1800 | 4.8-4.9 | 1.2 | 0.7-0.8 |
| | 1600 | 4.6 | 0.8 | 0.6 |
| | 1400 | 4.6-4.9 | 0.9 | 0.3 |
| | 1200 | 5.4-5.3 | 1.8 | 0.7-1.1 |
| | 1000 | 6.2 | 3.2 | 0.6-0.7 |

Figure 2:
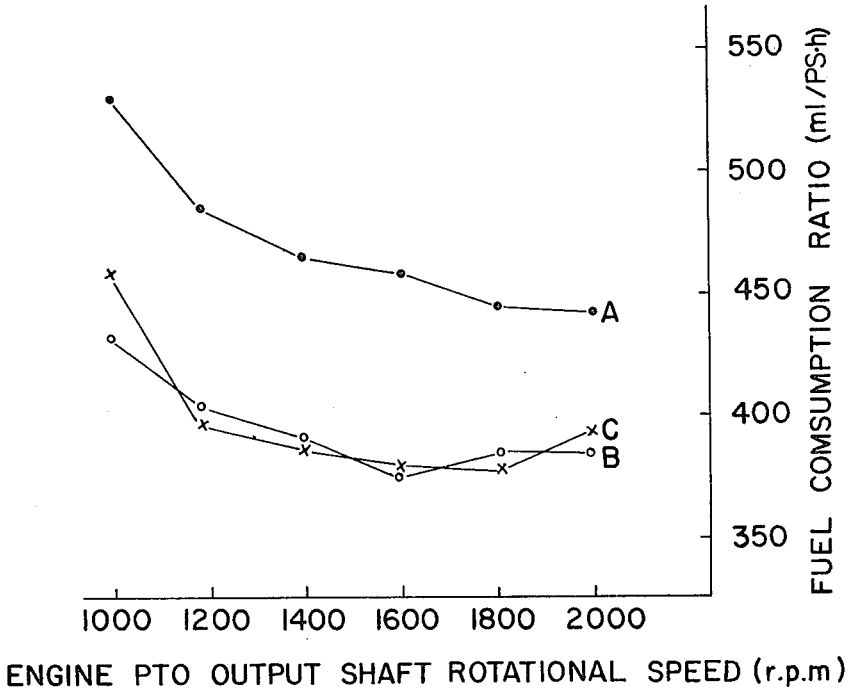
FIG. 2 is a graph showing the relationship between the fuel consumption ratio (ml/PS·h) and the engine PTO output shaft rotational speed (r.p.m.) in case of using the same fuels.

The above-described results are shown in FIGS. 1 and 2.

As shown in FIG. 1, 100% eucalyptus oil produces a large output power at every stage of the engine PTO output shaft rotational speed (r.p.m.) and the mixture comprising 30 vol.% commercially available gasoline and 70 vol.% eucalyptus oil produces almost the same output power as 100% commercially available gasoline.

Also, as is clear from FIG. 2, 100% eucalyptus oil and the mixture of 70 vol.% eucalyptus oil and 30 vol.% commercially available gasoline show about the same fuel consumption ratio (ml/PS·h) and show less fuel consumption ratios than 100% commercially available gasoline.

Further, Table 2 shows that 100% eucalyptus oil and the mixture of 70 vol.% eucalyptus oil and 30 vol.% gasoline produce an exhaust gas containing less carbon monoxide than that produced from 100% commercially available gasoline, thus the eucalyptus oil being demonstrated to contribute to the mitigation of environmental pollution resulting from the fuel.

EXAMPLE 2

With respect to the fuels a to e set forth below, the same engine tests as those in Example 1 were conducted except that the test engine was changed.

(I) Fuel a: 100% commercially available gasoline (the same gasoline as used in Example 1)

b: 100% eucalyptus oil (the same eucalyptus oil as used in Example 1)

c: 60 vol.% gasoline plus 40 vol.% eucalyptus oil d: 33.4 vol.% gasoline plus 33.3 vol.% eucalyptus oil plus 33.3 vol.% ethyl alcohol e: 50 vol.% gasoline plus 25 vol.% eucalyptus oil plus 25 vol.% ethyl alcohol (II) Engine

| | |
|---|---|
| Name: | Shibaura TEA0660 |
| Model: | Gasoline engine of air-cooled 2 stroke cycle type |
| Number of cyclinder: | 1 |
| Bore × Stroke | 45 × 38 mm |
| Total displacement: | 60 cc |
| Continous rated horsepower: | 1.8/1,600 PS/r.p.m. |
| Maximum horsepower: | 2.8/2,000 PS/r.p.m. |
| Maximum torque: | 1.08/1,330 Kg . m/r.p.m. |
| Compression ratio: | 6.5 |
| Ignition plug: | NGK B-6HS |
| Reduction gear ratio: | 1 |
| Standard main jet nozzle diameter: | 0.650 mm |
| Lubricating system: | Mixed lubrication (mixing ratio, 25:1) |

The relationship of the modified horsepower (PS) and fuel consumption ratio (ml/PS·h) with engine PTO output shaft rotational speed (r.p.m.) is shown in Table 3 below and attached FIG. 3.

TABLE 3

| | | Fuel | | | | |
|---|---|---|---|---|---|---|
| | | a | b | c | d | e |
| Fuel Composition | | | | | | |
| Gasoline (v/v) | | 100 | 0 | 60 | 33.4 | 50 |
| Eucalyptus oil (v/v) | | 0 | 100 | 40 | 33.3 | 25 |
| Ethyl Alcohol (v/v) | | 0 | 0 | 0 | 33.3 | 25 |
| Main jet nozzle diameter (mm) | | 0.650 | 0.700 | 0.650 | 0.650 | 0.650 |
| Specific Gravity | | 0.719 | 0.916 | 0.809 | 0.817 | 0.794 |
| | Engine PTO Output Shaft Rotational Speed (r.p.m.) | | | | | |
| | 3,000 | 1.52 | 1.53 | 1.46 | 1.46 | 1.49 |
| | 3.500 | 1.80 | 1.83 | 1.73 | 1.82 | 1.80 |
| Modified | 4,000 | 2.01 | 2.07 | 1.94 | 2.05 | 2.08 |
| Horsepower | 4,500 | 2.23 | 2.23 | 2.00 | 2.07 | 2.24 |
| (PS) | 5,000 | 2.36 | 2.33 | 2.13 | 2.24 | 2.36 |
| | 5,500 | 2,43 | 2.41 | 2.23 | 2.50 | 2.54 |
| | 6,000 | 2.51 | 2.45 | 2.38 | 2.60 | 2.65 |
| | 3,000 | 610 | 580 | 588 | 545 | 634 |
| | 3,500 | 584 | 542 | 570 | 514 | 560 |
| Fuel | 4,000 | 588 | 509 | 533 | 496 | 526 |
| Consumption Ratio | 4,500 | 558 | 479 | 510 | 493 | 489 |
| (ml/PS . h) | 5,000 | 535 | 467 | 485 | 477 | 480 |
| | 5,500 | 547 | 433 | 485 | 477 | 499 |
| | 6,000 | 556 | 427 | 506 | 489 | 482 |
| | 3,000 | 0.95 | 1.55 | 0.40 | 0.09 | 0.52 |
| Carbon monoxide | 3,500 | 0.55 | 1.65 | 0.35 | 0.12 | 0.67 |
| concentration | 4,000 | 0.88 | 1.75 | 0.25 | 0.11 | 0.53 |
| (%) | 4,500 | 0.33 | 2.10 | 0.11 | 0.12 | 0.16 |
| | 5,000 | 0.35 | 2.02 | 0.15 | 0.14 | 0.50 |
| | 5,500 | 1.03 | 1.45 | 0.19 | 0.21 | 1.15 |
| | 6,000 | 1.30 | 1.15 | 0.55 | 0.88 | 1.37 |

Figure 3:
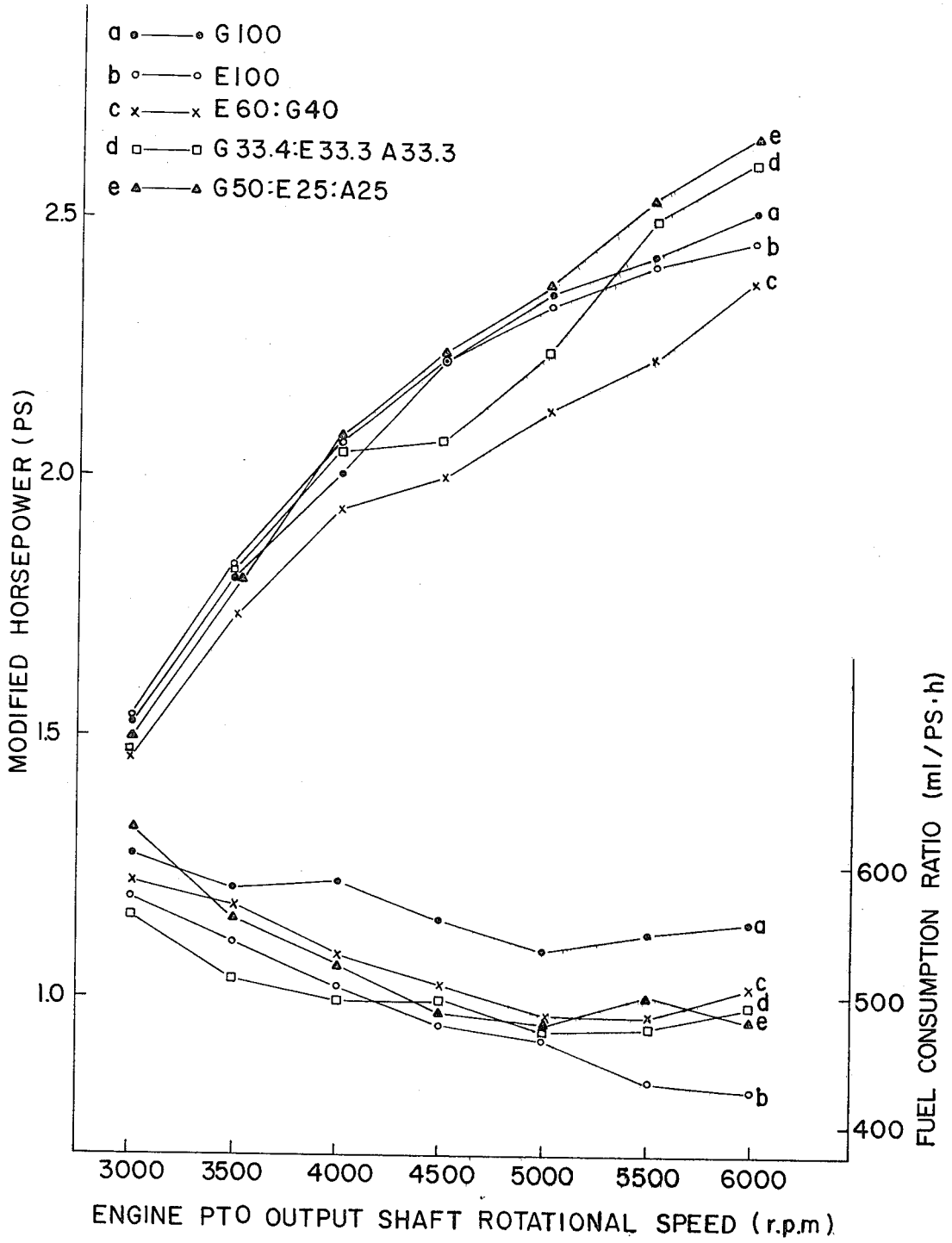
FIG. 3 is a graph showing the relationship between the modified horsepower (PS) or the fuel consumption ratio (ml/PS·h), and the engine PTO output shaft rotational speed (r.p.m.) as to 100% commercially available gasoline, 100% eucalyptus oil, a mixture (60:40 by volume) of eucalyptus oil and gasoline, a mixture (33.4:33.3:33.3 by volume) of gasoline, eucalyptus oil and ethyl alcohol, and a mixture (50:25:25 by volume) of gasoline, eucalyptus oil and ethyl alcohol.

As is clear from Table 3 and FIG. 3, the eucalyptus oil-containing fuels show a low carbon monoxide concentration in an exhaust as compared to 100% gasoline, except that 100% eucalyptus oil shows a high carbon monoxide concentration because the main jet nozzle diameter was enlarged to 0.700 mm. Further, although it has been usually considered that when ethyl alcohol is mixed, the fuel consumption ratio increases in proportion to the reduction of exotherm, the ethyl alcohol-containing fuels of the present invention show a low fuel consumption ratio as compared to 100% gasoline because the fuel consumption ratio of eucalyptus oil itself is low.

Incidentally, when water was added to the fuel d in an amount of 5.5 v/v per 10 v/v of the fuel, no phase separation was observed. Further, when water was added to the fuel e in an amount of 4 v/v per 10 v/v of the fuel, no phase separation was also observed. The water content of each of the resulting fuels d and e was 5.21% (v/v) and 3.85% (v/v), respectively.

While the invention has been described in detail and with reference to specific embodiments thereof, it will be apparent to one skilled in the art that various changes and modifications thereof can be made therein without departing from the spirit and scope thereof.

What is claimed is:

1. A composition useful as a fuel, said composition comprising an admixture of gasoline and a vegetable oil containing 1,8-cineole as a major component, said gasoline and said vegetable oil being admixed in amounts effective for forming fuel having a ratio of gasoline to said vegetable oil of 95:5 to 5:95 by volume.

2. The composition of claim 1 wherein said gasoline has a boiling point ranging from about 60° C. to about 200° C.

3. The composition of claim 2 wherein said composition contains a lower aliphatic alcohol.

4. The composition of claim 3 wherein said lower aliphatic alcohol is present in an amount up to 100% by volume based on the amount of said gasoline contained in said composition.

5. The composition of claim 3 or 4 wherein said gasoline is a gasoline having an octane number of 85 or less.

6. The composition of claim 3 or 4 wherein said lower aliphatic alcohol is at least one member selected from the group consisting of methyl alcohol, ethyl alcohol, n-propyl alcohol, isopropyl alcohol, n-butyl alcohol, sec-butyl alcohol and isobutyl alcohol.

7. The composition of claim 3 or 4 wherein said lower aliphatic alcohol is ethyl alcohol.

8. The composition of claim 1 wherein said vegetable oil contains at least 50% by volume of 1,8-cineole.

9. The composition of claim 1 wherein said vegetable oil is eucalyptus oil containing 1,8-cineole as a major component.

10. The composition of claim 8 wherein said vegetable oil is eucalyptus oil.

11. The composition of claim 1 wherein said composition is useful as fuel in an internal combustion engine.

* * * * *